US007406815B2

(12) United States Patent
Italiano

(10) Patent No.: US 7,406,815 B2
(45) Date of Patent: Aug. 5, 2008

(54) WESTERN-TYPE SADDLE PAD

(76) Inventor: Peter Italiano, 3 Lily Ct., Yorktown Heights, NY (US) 10598

( * ) Notice: Subject to any disclaimer, the term of this patent is extended or adjusted under 35 U.S.C. 154(b) by 242 days.

(21) Appl. No.: 11/176,632

(22) Filed: Jul. 6, 2005

(65) Prior Publication Data

US 2007/0006555 A1 Jan. 11, 2007

(51) Int. Cl.
*B68C 1/12* (2006.01)

(52) U.S. Cl. ..... 54/66

(58) Field of Classification Search ..... 54/65, 54/66

See application file for complete search history.

(56) References Cited

U.S. PATENT DOCUMENTS

| | | | | | |
|---|---|---|---|---|---|
| 351,706 | A | * | 10/1886 | Muller | 54/66 |
| 530,864 | A | * | 12/1894 | Torrey | 54/66 |
| 2,461,899 | A | * | 2/1949 | Humphrey | 54/66 |
| 3,323,287 | A | | 6/1967 | Hilmer | 54/66 |
| 4,136,506 | A | | 1/1979 | Miller | 54/66 |
| 4,683,709 | A | * | 8/1987 | Vasko et al. | 54/66 |
| 4,800,709 | A | | 1/1989 | Le Tixerant | 54/44 |
| 4,974,397 | A | | 12/1990 | Ricken | 54/66 |
| 5,575,139 | A | | 11/1996 | Green | 54/66 |
| 6,421,989 | B1 | | 7/2002 | Leson | 54/66 |
| 6,658,827 | B2 | | 12/2003 | Brownlie | 54/66 |

OTHER PUBLICATIONS

Skyline Equine, http://www.skylineequine.com/products/saddle_pads01.html (2003) "All purpose shaped fleece pad" (p. 1) "Dressage shaped cotton pad, fleece border and underlay" (p. 2).

Horse Tack Co, http:www.horsetackco.com/index.php/cPath/58_263 (Jun. 8, 2005) "Sheepskin" "HDR Fleece Wither Half Pad".

Horse Tack Co, http:www.horsetackco.com/index.php/cPath/58 (Jun. 8, 2005) "Griffin All Purpose Pad" "Griffin Dressage Pad".

Horseworld Emporium, http://www.horseworldemporium.com/web%20page17.html (June 8, 2005) "Saddle Half Pad" (p. 1) "Full Saddle Pad" (p. 1) "Fleeced Edge Pad" (p. 2).

Toklat Originals, http://www.toklat.com/pwp_coolback.html (Jul. 5, 2005) "Cool Back Barrel Race Pads" (pp. 1-2) "Cool Back Pads with Trim" (p. 2).

(Continued)

*Primary Examiner*—Rob Swiatek
(74) *Attorney, Agent, or Firm*—Morgan & Finnegan, LLP

(57) ABSTRACT

An saddle pad for use beneath a Western saddle that prevents the pad from slipping, shifting and riding out from under the saddle. The saddle pad is constructed with a substantially rigid peripheral restraint adjacent the pad's forward edge and projecting from the top surface of the pad to function as a restraining abutment should the saddle slip or shift. The peripheral restraint is constructed of an inner reinforcement member, preferably a braided nylon rope, which does not yield or collapse when the saddle is pushed against it and additionally provides a recess that mates with and securely engages the forwardmost edge of the saddle to lock the pad in place beneath the saddle. The pad is dimensioned to extend outwardly beyond the outer edges of the saddle, providing the saddle with limited freedom of movement relative to the pad.

7 Claims, 4 Drawing Sheets

OTHER PUBLICATIONS

Western Tack Accessories, http://www.unicornwoman.com/cat/uw_catwestern_accessories.htm (Jul. 5, 2005) "Corona Saddle Blanket".

Buford Saddle and Tack Co., http://www.bufordsaddle.com/blankets/pads_by_others.htm (Jul. 5, 2005) "Washable Corona Pad" (pp. 5-6) "Corona Show Pad Barrel Racer Style" (p. 6).

Arcola Feed Show Tack & Clothing, http://arcolafeed.com/English_Saddle_pads.htm (Jul. 5, 2005) "Ovation Double Fleece Pad" "Ovation Corona Plus Pad" "Ovation Corona Pad".

* cited by examiner

WESTERN-TYPE SADDLE PAD

TECHNICAL FIELD

The present invention relates generally to an improved saddle pad for use beneath a Western-type saddle.

BACKGROUND OF THE INVENTION

Saddle pads are widely used underneath saddles for the comfort and safety of the horse. The saddle pad provides a protective layer between the saddle and the body of the horse that is intended to produce a cushioning effect and also eliminate irritation due to chafing movement of the saddle.

Generally, there are two types of saddles; Western and English. Conventional saddle pads for Western-type saddles tend to slip or shift under the saddle causing the very discomfort and irritation the pad is intended to prevent. Attempts to solve this problem have been met with little success. For example, some Western-type saddle pads have been provided with regions made of material having non-slip properties such as neoprene. This has proven to be counterproductive because perspiration from the horse's back is not absorbed and an undesirable build-up of moisture tends to occur, causing the pad to slip.

Corona-style Western-type saddle pads have raised borders for decorative purposes. These raised borders are typically made of rolled or quilted fabric which have no rigidity and thus offer no resistance to slipping and shifting of the pad.

The provision of raised, non-rigid borders has been proposed for English-type saddle pads. U.S. Pat. No. 3,323,287 to Hilmer describes an English-type saddle pad having resilient edges extending both upwardly and downwardly from the two faces of the main portion of the pad. When in position under the saddle, the pad's resilient edges are aligned with the edges of the saddle and are tightly gripped between the body of the horse and saddle. This creates an air space between the saddle and the main portion of the pad for ventilation purposes. U.S. Pat. No. 4,974,397 to Ricken suggests use of a quilted border roll for an English-type saddle pad to snugly hold the saddle in place.

The foregoing patents do not address the unique problem associated with Western-type saddle pads of slipping and shifting underneath the saddle. Those English-type saddle pads are designed and intended to fit snugly with the saddle so there is no freedom of movement between the pad and saddle such as is desirable in Western-type saddle pads. As a consequence, movement of the saddle causes undesirable movement of the saddle pad as well. Moreover, because the raised borders proposed in these patents for English-type saddle pads have no substantial rigidity, they would not prevent slipping or shifting if incorporated into Western-type saddle pads.

Accordingly, it is an object of this invention to provide a Western-type saddle pad that does not slip, shift or ride out from under the saddle. It is a further object to provide such a saddle pad which provides limited freedom of movement between the pad and the saddle.

SUMMARY OF THE INVENTION

In accordance with the invention, a saddle pad dimensioned to extend substantially beyond the outer edges of a Western-type saddle is provided with a substantially rigid peripheral restraint projecting outwardly from its top surface adjacent the pad's forward edge to function as a restraining abutment should the saddle shift forward. This peripheral restraint retains the pad in place beneath the saddle while providing limited freedom of movement of the saddle relative to the pad. In one form of the invention, the restraint includes an inner reinforcement member, preferably a rope-like structure which, still more preferably, is approximately 0.75 inches in diameter. For optimum performance, the peripheral restraint may extend between points on the pad which, when the pad is in place beneath the saddle, are located substantially adjacent the forward edges of the two side fenders of the saddle.

In accordance with another aspect of the invention, it is preferred that the peripheral restraint be configured such that it forms, in conjunction with the outer surface of the top layer of the pad, a recess that mates with, receives and secures the forwardmost edge of the saddle so as to lock the saddle pad in place beneath the saddle.

These aspects and other objects, features, and advantages of the invention are described in the following Detailed Description, which is to be read in conjunction with the accompanying drawings.

DETAILED DESCRIPTION

Figure 4:
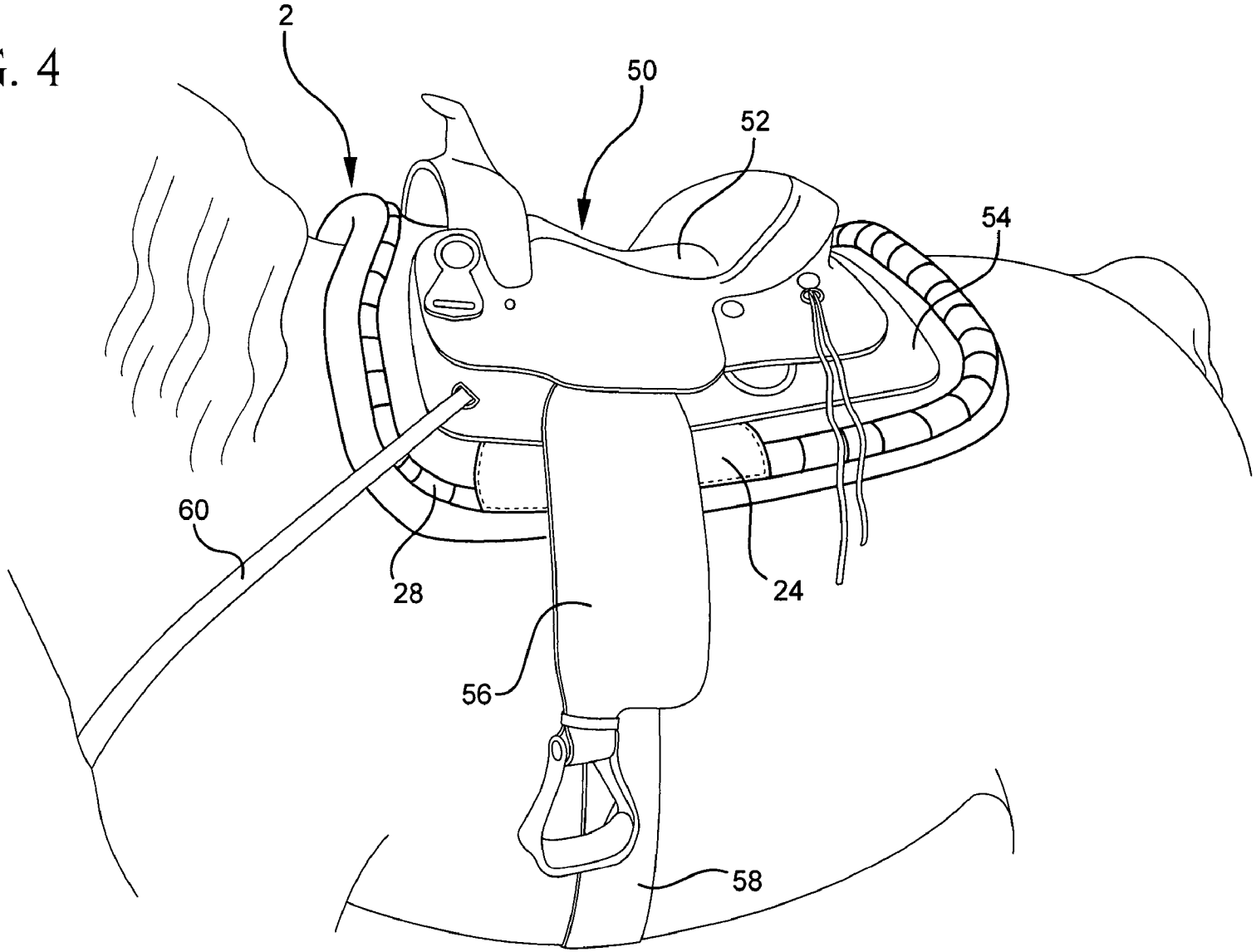
FIG. 4 is a perspective view of the embodiment of FIGS. 1, 2 and 3 in place beneath a Western-type saddle.

A preferred embodiment of the invention is illustrated in the drawings. The saddle pad 2 has a forward edge 4, side edges 6 and a back edge 8. Referring to FIG. 4, the saddle pad 2 is dimensioned so as to extend on all sides substantially beyond the outer edges of the saddle.

The pad may have any suitable construction. In the illustrative embodiment, and with specific reference to the cross-sectional view of FIG. 3, the body portion of the pad is constructed with a top layer 10, connecting layer 11, inner layers 12 and a bottom layer 14, which has a backing 15. The layers are constructed of flexible and resilient natural materials that are lightweight, readily conform to the saddle and the contours of the horse's body and provide for moisture wicking and ventilation. The top layer 10 and connecting layer 11 may be a cotton canvas. The inner layers 12 may be wool felt. The bottom layer 14 may be cotton fleece. The backing 15 may be a woven material.

Figure 1:
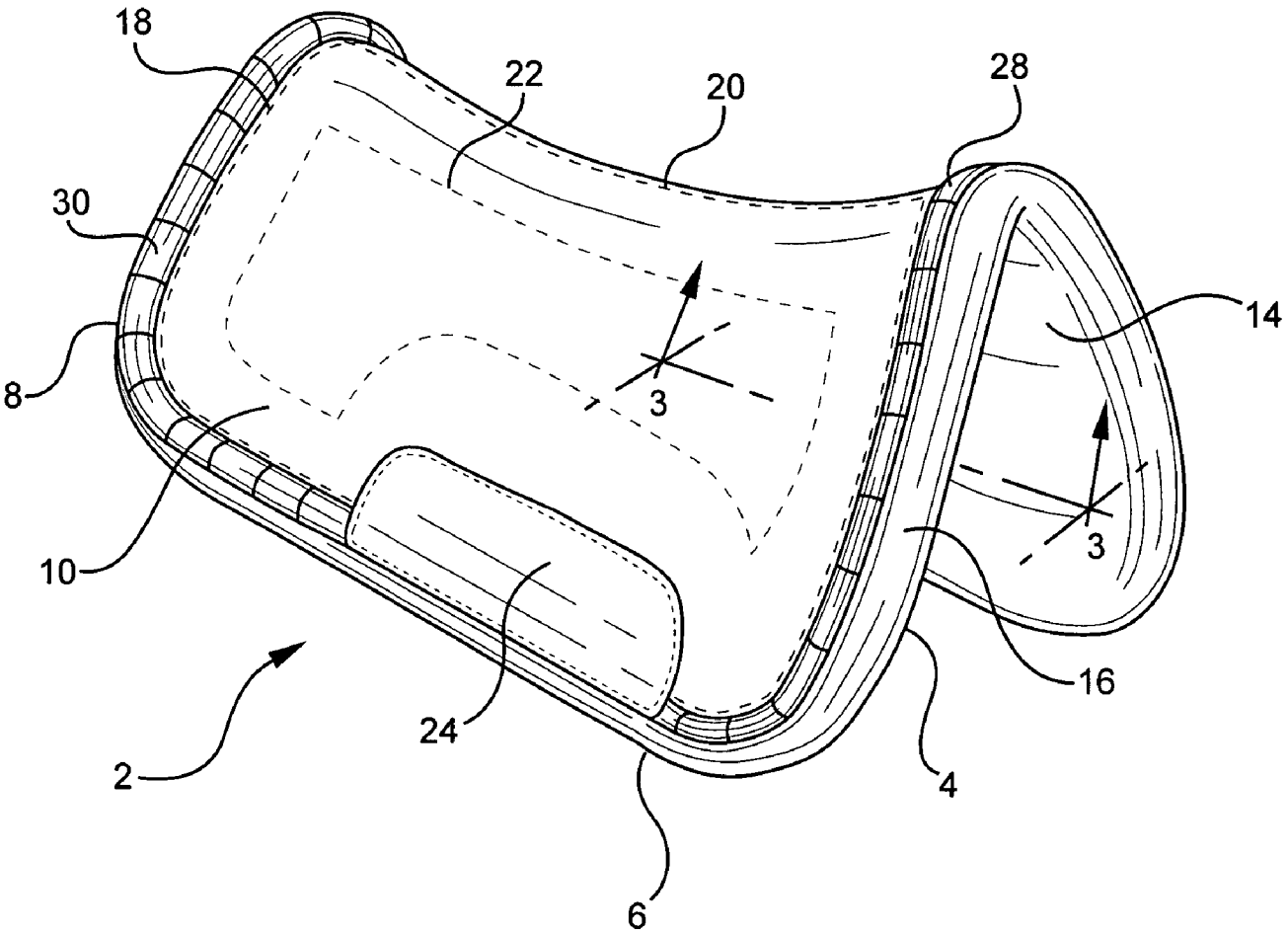
FIG. 1 is a perspective view of an embodiment of a Western-type saddle pad of the invention.
Figure 2:
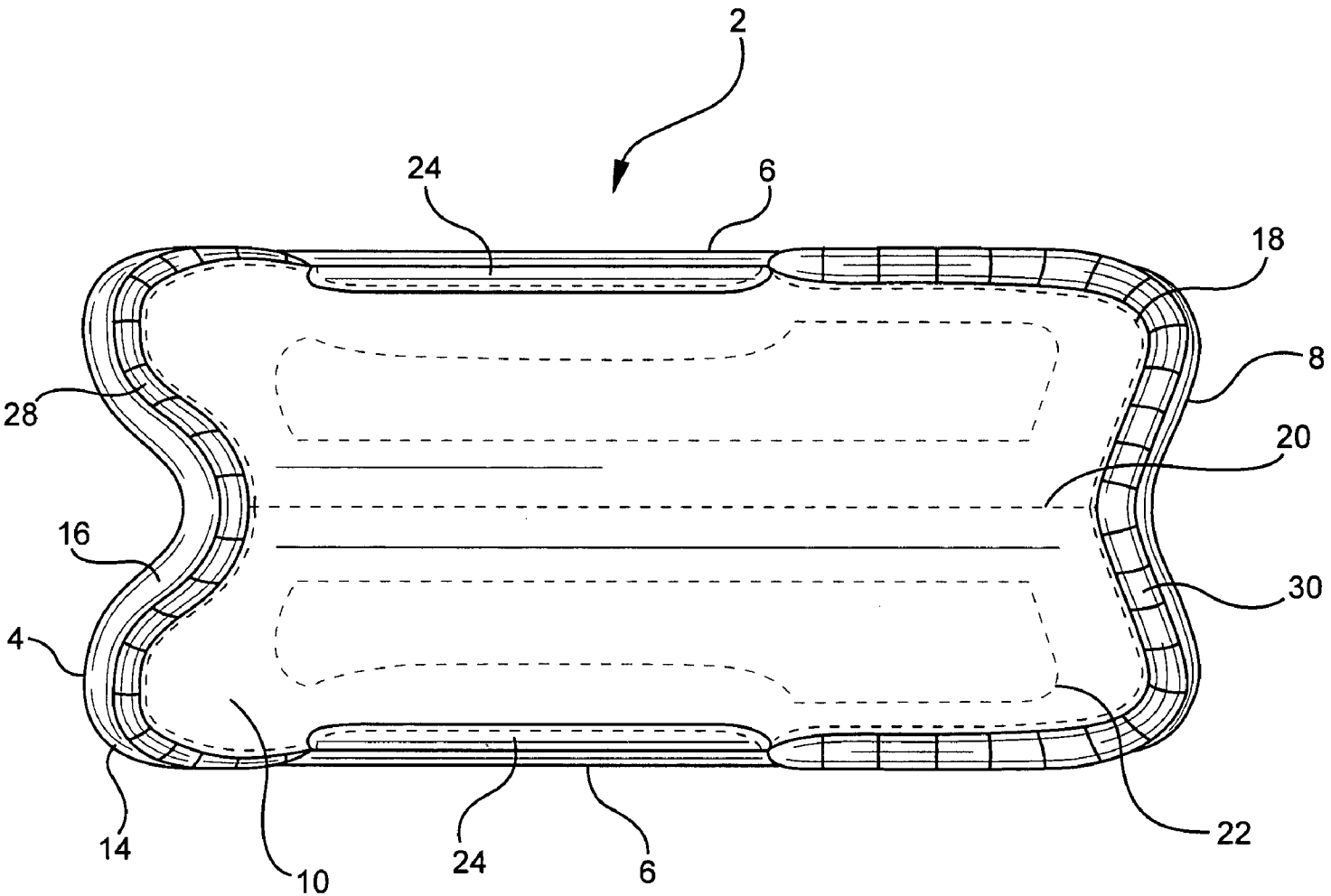
FIG. 2 is a top view of the embodiment of FIG. 1.
Figure 3:
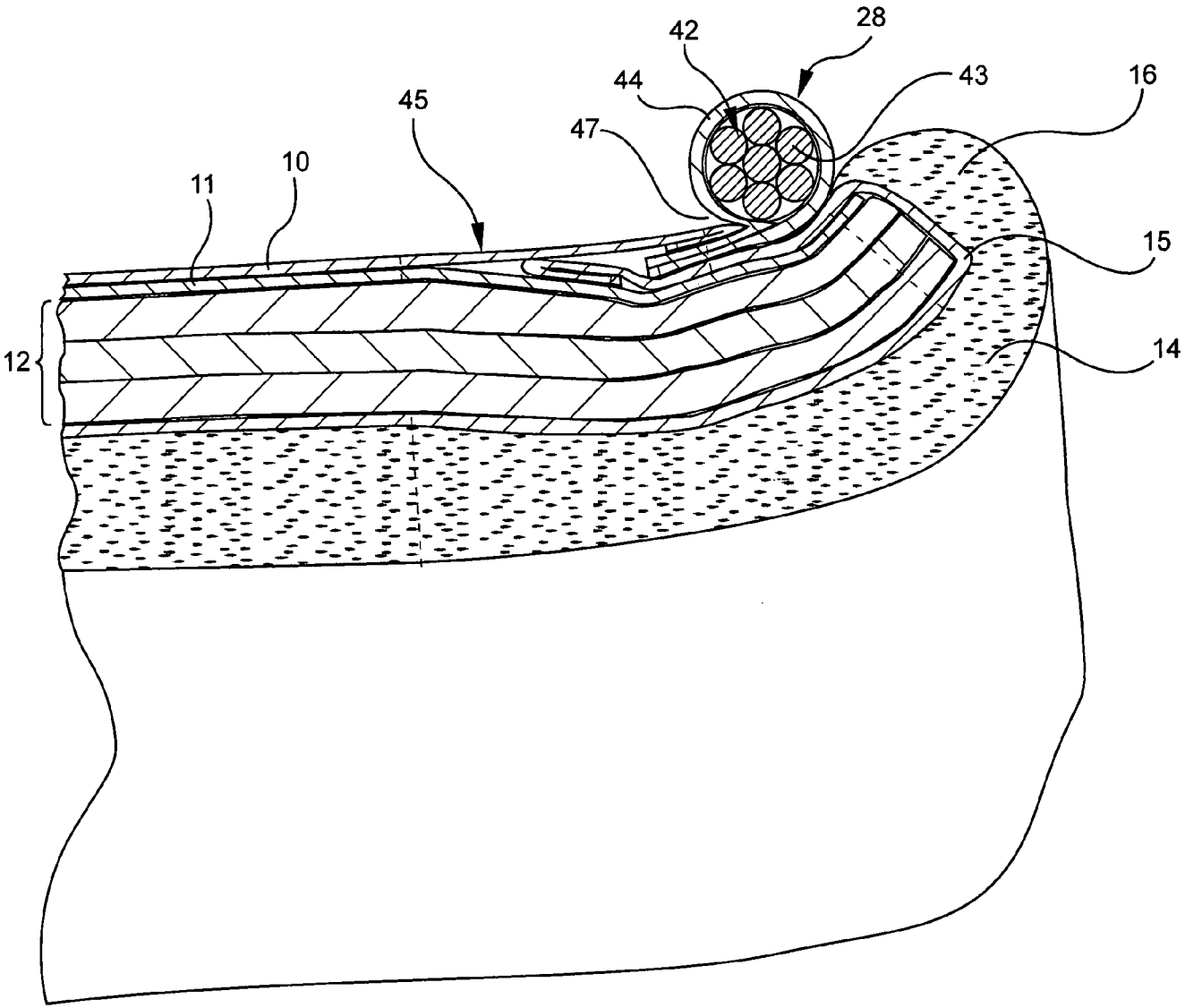
FIG. 3 is a cross-sectional view of the embodiment of FIGS. 1 and 2 taken along line 3-3 of FIG. 1 showing the structure of the pad and its peripheral restraint.

Referring to FIG. 1, the bottom layer 14 extends at its periphery outwardly beyond the top layer 10 and inner layers 12 (shown in FIG. 3). Thus, the bottom layer 14 is the only part of the saddle pad 2 that directly contacts the skin of the horse. The bottom layer 14 may have a rolled edge 16, which functions as a cushion to protect the horse's withers, ribs and loins. The various layers may be joined by peripheral stitching 18. As shown in FIGS. 1 and 2, the saddle pad also may have centerline stitching 20 and panel stitching 22 to further attach the plurality of layers.

As is typical with Western-type saddle pads, the pad of the invention is provided with wear leathers 24 on the outer surface of the top layer 10 adjacent and parallel to the side edges 6. As shown in FIG. 4, the wear leathers 24 protect the saddle pad from wear resulting from contact with the side fenders 56 of the saddle.

In accordance with the invention, saddle pad 2 is provided with peripheral restraint 28 secured to and projecting from the outer surface of the top layer 10 adjacent the forward edge 4. Preferably, as shown in FIG. 2, the peripheral restraint 28 extends between points adjacent the forward edges of the saddle pad wear leathers 24. When the pad is in place beneath the saddle as shown in FIG. 4, the peripheral restraint 28 extends between points located substantially adjacent to the forward edges of the side fenders 56 of the saddle. As described below with reference to FIGS. 3 and 4, the peripheral restraint 28 is constructed, dimensioned and positioned so as to form a substantially rigid restraining abutment to hold the saddle pad in place beneath the saddle to substantially prevent slipping or shifting of the pad, while at the same time allowing for limited freedom of movement of the saddle relative to the pad.

FIGS. 1 and 2 also show a rear peripheral roll 30 adjacent the back edge 8 and side edges 6 of the saddle pad 2 and extending between points adjacent the back edges of the saddle pad wear leathers 24. The rear peripheral roll 30, which may be pliable and resilient in structure, serves largely as a guide in centering the saddle on the saddle pad 2.

Cross-sectional view FIG. 3 shows the internal structure of peripheral restraint 28. In accordance with the invention, peripheral restraint 28 is substantially rigid in construction so as not to yield or collapse if the saddle is pushed against it. In the preferred embodiment illustrated in the drawings, peripheral restraint 28 is constructed with an inner reinforcement member in the form of a nylon rope 42 made of braided strands 43 appropriately secured within an outer flexible containment structure 44. It has been found that a braided nylon rope of approximately 0.75 inches in diameter functions particularly well to achieve the objectives of the invention. It will be appreciated, however, that peripheral restraint 28 may be of any suitable construction, material and dimension so long as it is substantially rigid and functions as a restraining abutment for the saddle. The outer flexible containment structure 44 may be a durable fabric secured by peripheral stitching 18 to the body of the pad.

Western-type saddles are typically constructed with a thin, rigid skirt that comprises the forwardmost edge of the saddle, as shown in FIG. 4. In accordance with another aspect of the invention, and with specific reference to FIG. 3, it is preferred that peripheral restraint 28 be configured such that it forms, in conjunction with the outer surface 45 of the top layer 10 of the saddle pad 2, a recess 47 that mates with, receives and secures the forwardmost edge of the saddle so as to lock the pad in place beneath the saddle.

Operation of the present invention will now be described with reference to FIG. 4. A Western-type saddle 50 typically includes a seat 52, a skirt 54, a pair of side fenders 56, a cinch 58 and a tie strap 60. The saddle 50 is placed and centered on the saddle pad 2 and secured to the horse by buckling the cinch 58 around the barrel of the horse. As the horse exercises and becomes warm, the cinch 58 will tend to loosen and slip as the barrel of the horse flexes and tightens. As a result, the saddle 50 will tend to shift forward toward the front shoulders or withers of the horse relative to the saddle pad 2. As the saddle 50 moves forward, the substantially rigid peripheral restraint 28 forms an unyielding abutment to the front edge of the skirt 54.

As also shown in FIG. 4, the peripheral restraint 28 preferably extends along the edges of the saddle pad between points substantially corresponding to the forward edges of the side fenders 56 of the saddle 50. This preferred construction provides a restraining abutment to engage the front corners and sides of the skirt 54 to substantially prevent the saddle pad 2 from riding out to the left or the right.

In accordance with another aspect of the invention, peripheral restraint 28 is spaced apart from the edge of the skirt 54 to allow for limited freedom of movement of the saddle relative to the saddle pad 2. As the horse exercises and the cinch loosens around the barrel of the horse, the saddle 50 will tend to move forward. The space between peripheral restraint 28 and the saddle skirt 54 allows the saddle to naturally adjust and position itself on the saddle pad 2. Consequently, movement of the saddle does not force the saddle pad 2 itself to move.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A Western-type saddle pad comprising a body portion that is dimensioned to extend outwardly substantially beyond the outer edges of a saddle having side fenders, said saddle pad having a top surface and further comprising a substantially rigid peripheral restraint attached to and projecting from said top surface adjacent the forward edge of said saddle pad, said peripheral restraint extending along said forward edge of said saddle pad and terminating forwardly of said side fenders when said saddle pad is in place beneath said saddle, said peripheral restraint being spaced from the forward edge of said saddle when said saddle pad is in place beneath said saddle, whereby said peripheral restraint allows limited freedom of movement of said saddle relative to said saddle pad while providing a substantially unyielding abutment to retain said saddle pad in place beneath said saddle and substantially prevent said saddle pad from slipping or shifting.

2. The saddle pad of claim 1, wherein said peripheral restraint forms, in conjunction with the outer surface of said top surface of said saddle pad, a recess that mates with and receives the forwardmost edge of said saddle so as to securely hold said saddle pad in place beneath said saddle.

3. The saddle pad of claim 1, wherein said peripheral restraint includes an inner reinforcement member.

4. The saddle pad of claim 1, wherein said peripheral restraint includes a rope-like structure.

5. The saddle pad of claim 4, wherein said rope-like structure is within a flexible outer containment.

6. The saddle pad of claim 5, wherein said rope-like structure is approximately 0.75 inches in diameter.

7. The saddle pad of claim 4, wherein said rope-like structure is approximately 0.75 inches in diameter.

* * * * *

UNITED STATES PATENT AND TRADEMARK OFFICE

CERTIFICATE OF CORRECTION

PATENT NO. : 7,406,815 B2
APPLICATION NO. : 11/176632
DATED : August 5, 2008
INVENTOR(S) : Peter Italiano It is certified that error appears in the above-identified patent and that said Letters Patent is hereby corrected as shown below:

At column 4, line 55, correct the dependency of claim 6 to --4-- as follows:

Claim 6. The saddle pad of claim 4, wherein said rope-like structure is approximately 0.75 inches in diameter.

At column 4, line 57, correct the dependency of claim 7 to --5-- as follows:

Claim 7. The saddle pad of claim 5, wherein said rope-like structure is approximately 0.75 inches in diameter.

Signed and Sealed this

Thirtieth Day of September, 2008

JON W. DUDAS
*Director of the United States Patent and Trademark Office*